US009950361B2

(12) United States Patent
Ownby et al.

(10) Patent No.: US 9,950,361 B2
(45) Date of Patent: Apr. 24, 2018

(54) INSULATION ENCLOSURE WITH A THERMAL MASS

(71) Applicant: Halliburton Energy Services, Inc., Houston, TX (US)

(72) Inventors: Clayton A. Ownby, Houston, TX (US); Grant O. Cook, III, Spring, TX (US); Jeffrey G. Thomas, Magnolia, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 267 days.

(21) Appl. No.: 14/440,426

(22) PCT Filed: Jun. 25, 2014

(86) PCT No.: PCT/US2014/044004

§ 371 (c)(1),
(2) Date: May 4, 2015

(87) PCT Pub. No.: WO2015/199670

PCT Pub. Date: Dec. 30, 2015

(65) Prior Publication Data

US 2016/0297001 A1 Oct. 13, 2016

(51) Int. Cl.

| | |
|---|---|
| ***B22D 27/04*** | (2006.01) |
| ***B22F 3/00*** | (2006.01) |
| *B22F 5/00* | (2006.01) |
| *C22C 1/10* | (2006.01) |

(52) U.S. Cl.

CPC ..... *B22D 27/045* (2013.01); *B22D 27/04* (2013.01); *B22F 3/003* (2013.01); *B22F 2005/001* (2013.01); *B22F 2999/00* (2013.01); *C22C 2001/1073* (2013.01)

(58) Field of Classification Search

CPC ..... B22D 27/045; B22D 27/04
USPC ..... 164/135
See application file for complete search history.

(56) References Cited

U.S. PATENT DOCUMENTS 3,532,155 A * 10/1970 Anderson ..... B22D 27/045 164/122.1
4,113,473 A 9/1978 Gauvry et al.
4,409,451 A * 10/1983 Taylor ..... B22D 27/045 164/507

(Continued)

FOREIGN PATENT DOCUMENTS

GB 2343194 A 5/2000
GB 2364529 A 1/2002

(Continued)

OTHER PUBLICATIONS

International Search Report and Written Opinion for PCT/US2014/044004 dated Mar. 23, 2015.

*Primary Examiner* — Scott Kastler
(74) *Attorney, Agent, or Firm* — McDermott Will & Emery LLP

(57) ABSTRACT

An example insulation enclosure includes a support structure having a top end, a bottom end, and an opening defined at the bottom end for receiving a mold within an interior of the support structure, and a thermal mass arranged at the top end of the support structure to thermally communicate with a top of the mold and resist heat flow from the top of the mold in an axial direction.

12 Claims, 4 Drawing Sheets

(56) References Cited

U.S. PATENT DOCUMENTS

| | | | | |
|---|---|---|---|---|
| 6,035,924 | A | 3/2000 | Graham | |
| 6,220,117 | B1 | 4/2001 | Butcher | |
| 2009/0301682 | A1 | 12/2009 | Proske et al. | |
| 2010/0135842 | A1* | 6/2010 | Pezzutti | B22D 27/04 420/15 |
| 2013/0180693 | A1* | 7/2013 | Gomez | B23K 37/006 165/135 |

FOREIGN PATENT DOCUMENTS

| | | | |
|---|---|---|---|
| JP | 2006321684 | A | 11/2006 |
| JP | 2014008775 | A | 1/2014 |
| WO | 2015199670 | A1 | 12/2015 |

* cited by examiner

INSULATION ENCLOSURE WITH A THERMAL MASS

BACKGROUND

The present disclosure relates to oilfield tool manufacturing and, more particularly, to insulation enclosures that help control the thermal profile of drill bits during manufacture to prevent manufacturing defects.

Rotary drill bits are often used to drill oil and gas wells, geothermal wells, and water wells. One type of rotary drill bit is a fixed-cutter drill bit having a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body. The drilling fluids lubricate the cutting elements on the matrix drill bit.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be provided by shaping the mold cavity and/or by positioning temporary displacement material within interior portions of the mold cavity. A preformed bit blank (or steel shank) may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

The mold is then placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature. Once the designated process time or temperature has been reached, the mold containing the infiltrated matrix bit is removed from the furnace. As the mold is removed from the furnace, the mold begins to rapidly lose heat to its surrounding environment via heat transfer, such as radiation and/or convection in all directions, including both radially from a bit axis and axially parallel with the bit axis. Upon cooling, the infiltrated binder (e.g., metallic alloy) solidifies and incorporates the matrix reinforcement material to form a metal-matrix composite bit body and also binds the bit body to the bit blank to form the resulting matrix drill bit.

Typically, cooling begins at the periphery of the infiltrated matrix and continues inwardly, with the center of the bit body cooling at the slowest rate. Thus, even after the surfaces of the infiltrated matrix of the bit body have cooled, a pool of molten material may remain in the center of the bit body. As the molten material cools, there is a tendency for shrinkage that could result in voids forming within the bit body unless molten material is able to continuously backfill such voids. In some cases, for instance, one or more intermediate regions within the bit body may solidify prior to adjacent regions and thereby stop the flow of molten material to locations where shrinkage porosity is developing. In other cases, shrinkage porosity may result in poor metallurgical bonding at the interface between the bit blank and the molten materials, which can result in the formation of cracks within the bit body that can be difficult or impossible to inspect. When such bonding defects are present and/or detected, the drill bit is often scrapped during or following manufacturing or the lifespan of the drill bit may be dramatically reduced. If these defects are not detected and the drill bit is used in a job at a well site, the bit can fail and/or cause damage to the well including loss of rig time.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to oilfield tool manufacturing and, more particularly, to insulation enclosures that help control the thermal profile of drill bits during manufacture to prevent manufacturing defects.

The embodiments described herein provide an insulation enclosure that includes a thermal mass arranged at the top of the insulation enclosure that resists the net rate of heat loss from the mold and otherwise helps resist heat flow from the mold in the axial direction as it cools. In some cases, the thermal mass may be a resistive thermal mass that incorporates additional insulating materials or insulating techniques that resist heat flow and thereby retard the radiative heat flux from the top of the mold. In other cases, the thermal mass may be a passive or active heating thermal mass that emits thermal energy toward the top of the mold to alter the heat flux profile of the mold and reduce heat loss from the top of the mold. In either case, the thermal mass positioned above the mold, in conjunction with cooling below the mold via a thermal heat sink, may facilitate a more controlled cooling process for the mold and optimize the directional solidification of the molten contents within the mold along the longitudinal, or axial, direction.

Figure 1:
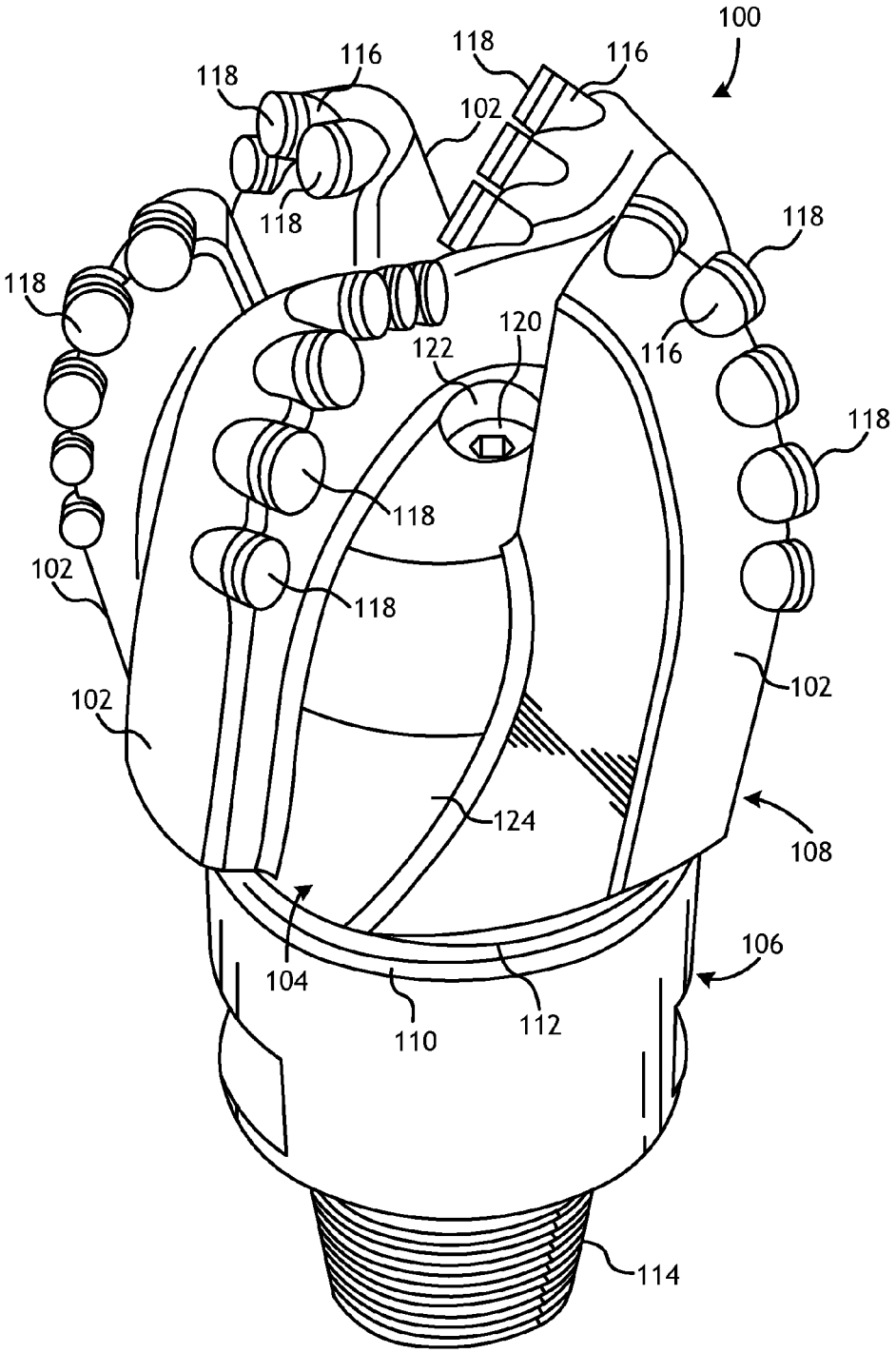
FIG. 1 illustrates an exemplary fixed-cutter drill bit that may be fabricated in accordance with the principles of the present disclosure.

FIG. 1 illustrates a perspective view of an example of a fixed-cutter drill bit 100 that may be fabricated in accordance with the principles of the present disclosure. As illustrated, the fixed-cutter drill bit 100 (hereafter "the drill bit 100") may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple pockets or recesses 116 (also referred to as "sockets" and/or "receptacles") are formed. Cutting elements 118, otherwise known as inserts, may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid (commonly referred to as "mud") can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Formed between each adjacent pair of cutter blades 102 are junk slots 124, along which cuttings, downhole debris, formation fluids, drilling fluid, etc., may pass and circulate back to the well surface within an annulus formed between exterior portions of the drill string and the interior of the wellbore being drilled (not expressly shown).

Figure 2A:
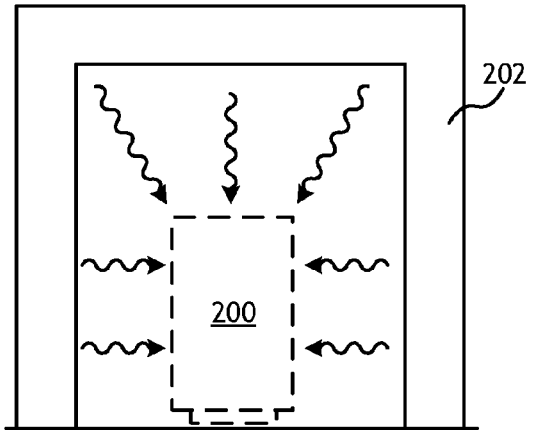
FIGS. 2A-2C illustrate progressive schematic diagrams of an exemplary method of fabricating a drill bit, in accordance with the principles of the present disclosure.
Figure 2B:
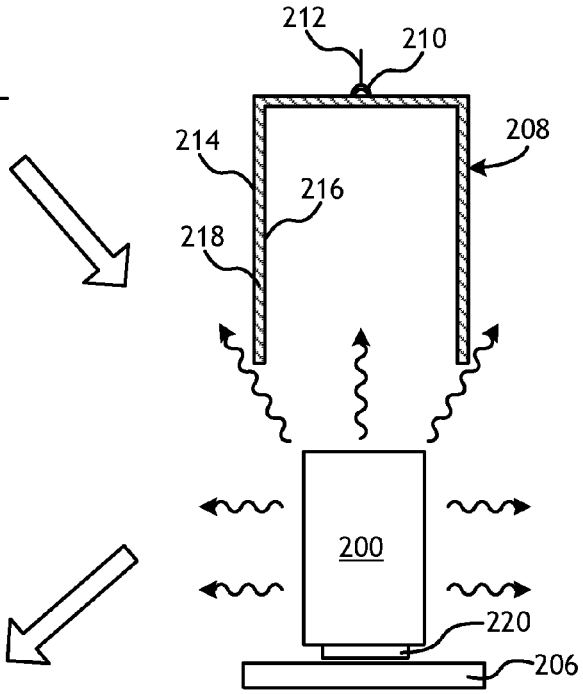
Figure 2C:
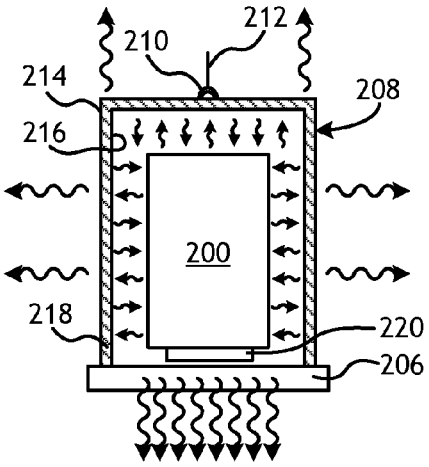

FIGS. 2A-2C are schematic diagrams that sequentially illustrate an example method of fabricating a drill bit, such as the drill bit 100 of FIG. 1, in accordance with the principles of the present disclosure. In FIG. 2A, a mold 200 is placed within a furnace 202. While not specifically depicted in FIGS. 2A-2C, the mold 200 may include and otherwise contain all the necessary materials and component parts required to produce a drill bit including, but not limited to, reinforcement materials, a binder material, displacement materials, a bit blank, etc.

For some applications, two or more different types of matrix reinforcement materials or powders may be positioned in the mold 200. Examples of such matrix reinforcement materials may include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used. Various binder (infiltration) materials that may be used include, but are not limited to, metallic alloys of copper (Cu), nickel (Ni), manganese (Mn), lead (Pb), tin (Sn), cobalt (Co) and silver (Ag). Phosphorous (P) may sometimes also be added in small quantities to reduce the melting temperature range of infiltration materials positioned in the mold 200. Various mixtures of such metallic alloys may also be used as the binder material.

The temperature of the mold 200 and its contents are elevated within the furnace 202 until the binder liquefies and is able to infiltrate the matrix material. Once a specified location in the mold 200 reaches a certain temperature in the furnace 202, or the mold 200 is otherwise maintained at a particular temperature within the furnace 202 for a predetermined amount of time, the mold 200 is then removed from the furnace 202. Upon being removed from the furnace 202, the mold 200 immediately begins to lose heat by radiating thermal energy to its surroundings while heat is also convected away by cold air from outside the furnace 202. In some cases, as depicted in FIG. 2B, the mold 200 may be transported to and set down upon a thermal heat sink 206. The radiative and convective heat losses from the mold 200 to the environment continue until an insulation enclosure 208 is lowered around the mold 200.

The insulation enclosure 208 may be a rigid shell or structure used to insulate the mold 200 and thereby slow the cooling process. In some cases, the insulation enclosure 208 may include a hook 210 attached to a top surface thereof. The hook 210 may provide an attachment location, such as for a lifting member, whereby the insulation enclosure 208 may be grasped and/or otherwise attached to for transport. For instance, a chain or wire 212 may be coupled to the hook 210 to lift and move the insulation enclosure 208, as illustrated. In other cases, a mandrel or other type of manipulator (not shown) may grasp onto the hook 210 to move the insulation enclosure 208 to a desired location.

In some embodiments, the insulation enclosure 208 may include an outer frame 214, an inner frame 216, and insulation material 218 positioned between the outer and inner frames 214, 216. In some embodiments, both the outer frame 214 and the inner frame 216 may be made of rolled steel and shaped (i.e., bent, welded, etc.) into the general shape, design, and/or configuration of the insulation enclosure 208. In other embodiments, the inner frame 216 may be a metal wire mesh that holds the insulation material 218 between the outer frame 214 and the inner frame 216. The insulation material 218 may be selected from a variety of insulative materials, such as those discussed below. In at least one embodiment, the insulation material 218 may be a ceramic fiber blanket, such as INSWOOL® or the like.

As depicted in FIG. 2C, the insulation enclosure 208 may enclose the mold 200 such that thermal energy radiating from the mold 200 is dramatically reduced from the top and sides of the mold 200 and is instead directed substantially downward and otherwise toward/into the thermal heat sink 206 or back towards the mold 200. In the illustrated embodiment, the thermal heat sink 206 is a cooling plate designed to circulate a fluid (e.g., water) at a reduced temperature relative to the mold 200 (i.e., at or near ambient) to draw thermal energy from the mold 200 and into the circulating fluid, and thereby reduce the temperature of the mold 200. In other embodiments, however, the thermal heat sink 206 may be any type of cooling device or heat exchanger configured to encourage heat transfer from the bottom 220 of the mold 200 to the thermal heat sink 206. In yet other embodiments, the thermal heat sink 206 may be any stable or rigid surface that may support the mold 200, and preferably having a high thermal capacity, such as a concrete slab or flooring.

Accordingly, once the insulation enclosure 208 is arranged about the mold 200 and the thermal heat sink 206 is operational, the majority of the thermal energy is transferred away from the mold 200 through the bottom 220 of the mold 200 and into the thermal heat sink 206. This controlled cooling of the mold 200 and its contents (i.e., the matrix drill bit) allows a user to regulate or control the thermal profile of the mold 200 to a certain extent and may result in directional solidification of the molten contents of the drill bit positioned within the mold 200, where axial solidification of the drill bit dominates its radial solidification. Within the mold 200, the face of the drill bit (i.e., the end of the drill bit that includes the cutters) may be positioned at the bottom 220 of the mold 200 and otherwise adjacent the thermal heat sink 206 while the shank 106 (FIG. 1) may be positioned adjacent the top of the mold 200. As a result, the drill bit may be cooled axially upward, from the cutters 118 (FIG. 1) toward the shank 106 (FIG. 1). Such directional solidification (from the bottom up) may prove advantageous in reducing the occurrence of voids due to shrinkage porosity, cracks at the interface between the bit blank and the molten materials, and nozzle cracks.

While FIG. 1 depicts a fixed-cutter drill bit 100 and FIGS. 2A-2C discuss the production of a generalized drill bit within the mold 200, the principles of the present disclosure are equally applicable to any type of oilfield drill bit or cutting tool including, but not limited to, fixed-angle drill bits, roller-cone drill bits, coring drill bits, bi-center drill bits, impregnated drill bits, reamers, stabilizers, hole openers, cutters, cutting elements, and the like. Moreover, it will be appreciated that the principles of the present disclosure may further apply to fabricating other types of tools and/or components formed, at least in part, through the use of molds. For example, the teachings of the present disclosure may also be applicable, but not limited to, non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

According to the present disclosure, controlling the thermal profile of the mold 200 may be enhanced by modifying the configuration and/or design of the insulation enclosure 208. More specifically, the embodiments described herein provide an insulation enclosure that includes a thermal mass arranged at the top of the insulation enclosure to resist heat flow in the axial direction above the mold 200 as it cools. In some embodiments, the thermal mass may be a resistive thermal mass that incorporates additional insulating materials or techniques to resist heat flow and thereby retard the heat flux emanating from the top of the mold 200. In other embodiments, the thermal mass may be a passive or active heating thermal mass that emits heat or thermal energy toward the mold 200 from the top of the insulation enclosure, and thereby alters the heat flux profile of the mold 200 by reducing heat loss from the top of the mold 200. In either case, the thermal mass positioned above the mold 200, in conjunction with cooling below the mold via the thermal heat sink 206, may facilitate a more controlled cooling process for the mold 200 and optimize the directional solidification of the molten contents within the mold 200 (e.g., a drill bit) along the longitudinal, or axial, direction. Through directional solidification, any potential defects (e.g., voids) may be formed at higher and/or more outward positions of the mold 200 where they can be machined off later during finishing operations.

Figure 3:
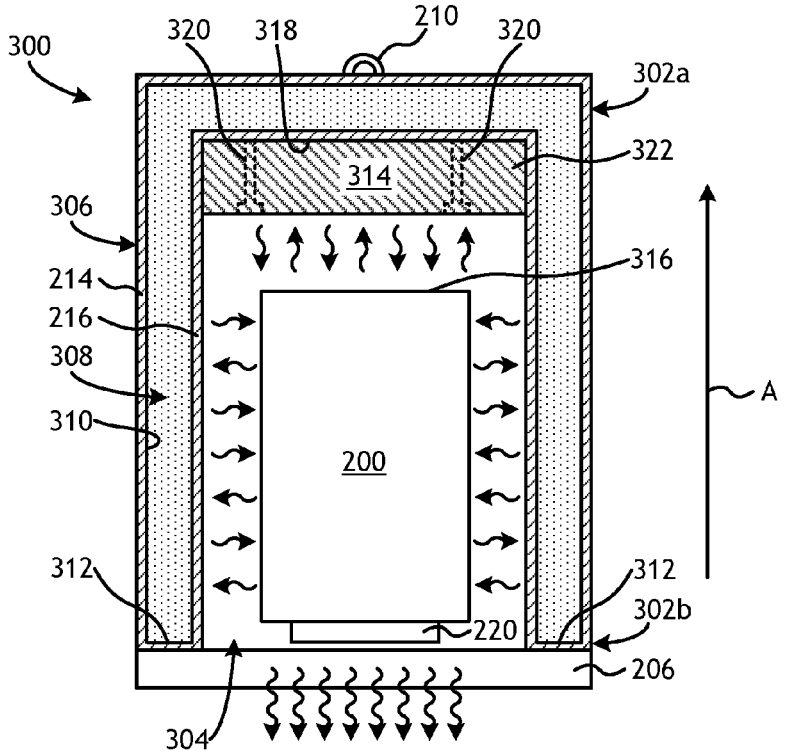
FIG. 3 illustrates a cross-sectional side view of an exemplary insulation enclosure, according to one or more embodiments.

FIG. 3 illustrates a cross-sectional side view of an exemplary insulation enclosure 300, according to one or more embodiments. The insulation enclosure 300 may be similar in some respects to the insulation enclosure 208 of FIGS. 2B and 2C and therefore may be best understood with reference thereto, where like numerals indicate like elements or components not described again. The insulation enclosure 300 may include a support structure 306 that defines or otherwise provides the general shape and configuration of the insulation enclosure 300. In some embodiments, the support structure 306 may be an open-ended cylindrical structure having a top end 302*a* and a bottom end 302*b*. The bottom end 302*b* may be open or otherwise define an opening 304 configured to receive the mold 200 within the interior of the support structure 306 as the insulation enclosure 300 is lowered around the mold 200. The top end 302*a* may be closed and provide the hook 210 (or similar device) on its outer surface, as described above.

In some embodiments, as illustrated, the support structure 306 may include the outer frame 214 and the inner frame 216, as generally described above. In other embodiments, however, one of the outer or inner frames 214, 216 may be omitted from the support structure 306 such that the support structure 306 alternatively includes only one of the outer and inner frames 214, 216, without departing from the scope of the present disclosure.

The support structure 306, including one or both of the outer and inner frames 214, 216, may be made of any rigid material including, but not limited to, metals, ceramics (e.g., a molded ceramic substrate), composite materials, combinations thereof, and the like. In at least one embodiment, one or both of the outer and inner frames 214, 216 may be a metal mesh. The support structure 306 may exhibit any suitable horizontal cross-sectional shape that will accommodate the general shape of the mold 200 including, but not limited to, circular, ovular, polygonal, polygonal with rounded corners, or any hybrid thereof. In some embodiments, the support structure 306 may exhibit different horizontal cross-sectional shapes and/or sizes at different locations along the height of the insulation enclosure 300.

In some embodiments, as illustrated, the insulation enclosure 300 may further include insulation material 308 supported by the support structure 306. The insulation material 308 may generally extend between the top and bottom ends 302*a,b* of the support structure 306 and also across the top end 302*a*, thereby substantially surrounding or otherwise encapsulating the mold 200 with the insulation material 308 (except for the bottom end 302*b*).

The insulation material 308 may be similar to the insulation material 218 of FIGS. 2B and 2C and may include, but is not limited to, ceramics (e.g., oxides, carbides, borides, nitrides, and silicides that may be crystalline, non-crystalline, or semi-crystalline), polymers, insulating metal composites, carbons, nanocomposites, foams, fluids (e.g., air), any composite thereof, or any combination thereof. The insulation material 308 may further include, but is not limited to, materials in the form of beads, particulates, flakes, fibers, wools, woven fabrics, bulked fabrics, sheets, bricks, stones, blocks, cast shapes, molded shapes, foams, sprayed insulation, and the like, any hybrid thereof, or any combination thereof. Accordingly, examples of suitable materials that may be used as the insulation material 308 may include, but are not limited to, ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, metal forgings, and the like, any composite thereof, or any combination thereof.

Suitable materials that may be used as the insulation material 308 may be capable of maintaining the mold 200 at temperatures ranging from a lower limit of about −200° C. (−325° F.), −100° C. (−150° F.), 0° C. (32° F.), 150° C. (300° F.), 175° C. (350° F.), 260° C. (500° F.), 400° C. (750° F.), 480° C. (900° F.), or 535° C. (1000° F.) to an upper limit of about 870° C. (1600° F.), 815° C. (1500° F.), 705° C. (1300° F.), 535° C. (1000° F.), 260° C. (500° F.), 0° C. (32° F.), or −100° C. (−150° F.), wherein the temperature may range from any lower limit to any upper limit and encompass any subset therebetween. Moreover, suitable materials that may be used as the insulation material 308 may be able to withstand temperatures ranging from a lower limit of about −200° C. (−325° F.), −100° C. (−150° F.), 0° C. (32° F.), 150° C. (300° F.), 260° C. (500° F.), 400° C. (750° F.), or 535° C. (1000° F.) to an upper limit of about 870° C. (1600° F.), 815° C. (1500° F.), 705° C. (1300° F.), 535° C. (1000° F.), 0° C. (32° F.), or −100° C. (−150° F.), wherein the temperature may range from any lower limit to any upper limit and encompass any subset therebetween. Those skilled in the art will readily appreciate that the insulation material 308 may be appropriately chosen for the particular application and temperature to be maintained within the insulation enclosure 300.

The insulation material 308 may be supported by the support structure 306 via various configurations of the insulation enclosure 300. For instance, as depicted in the illustrated embodiment, the outer and inner frames 214, 216 may cooperatively define a cavity 310, and the cavity 310 may be configured to receive and otherwise house the insulation material 308 therein. In some embodiments, the support structure 306 may further include a footing 312 at the bottom end 302*b* of the insulation enclosure 300 that extends between the outer and inner frames 214, 216. The footing 312 may serve as a support for the insulation material 308, and may prove especially useful when the insulation material 308 includes stackable and/or individual component insulative materials, such as ceramic blocks (molded or cast), fire bricks, graphite blocks, metal foams, metal castings, and metal forgings that may be stacked atop one another within the cavity 310.

In other embodiments, however, as indicated above, one of the outer and inner frames 214, 216 may be omitted from the insulation enclosure 300 and the insulation material 308 may alternatively be supported by the footing 312 as extended from either the outer or inner frame 214, 216 (depending on which remains in the configuration). In yet other embodiments, the insulation material 308 may alternatively be coupled directly to the outer and/or inner frames 214, 216 using, for example, one or more mechanical fasteners (e.g., bolts, screws, pins, etc.), without departing from the scope of the disclosure.

The insulation enclosure 300 may further include a thermal mass 314 arranged at or near the top end 302*a* of the insulation enclosure 300 (i.e., the support structure 306). As described herein, the thermal mass 314 may be useful in resisting heat flow from a top 316 of the mold 200 during cooling. More particularly, the thermal mass 314 may help slow the cooling process of the top 316 of the mold 200 in the axial direction A and subsequently through the top end 302*a* of the insulation enclosure 300. Accordingly, arranging the thermal mass 314 "at or near" the top end 302*a* of the insulation enclosure 300 may allow the thermal mass 314 to thermally communicate with the top 316 of the mold 200.

The thermal mass 314 may be coupled to or arranged on the insulation enclosure 300 at various locations at or near the top end 302*a* of the support structure 306. In the illustrated embodiment, for instance, the thermal mass 314 is depicted as being positioned within the interior of the insulation enclosure 300 (i.e., the support structure 306) and otherwise secured to an inner surface 318 of the support structure 306. In other embodiments, however, the thermal mass 314 may alternatively be positioned between the outer and inner frames 216, 214 at the top end 302*a* of the support structure 306. In yet other embodiments, the thermal mass 314 may be arranged on the exterior of the insulation enclosure 300, such as on an exterior surface of the outer frame 214 (or an exterior surface of the inner frame 216 in the event the outer frame 214 is omitted), without departing from the scope of the disclosure.

In the illustrated embodiment, the thermal mass 314 may be secured to the inner surface 318 of the support structure 306 using one or more mechanical fasteners 320 (two shown), such as bolts, screws, pins, etc. In other embodiments, however, or in addition thereto, the thermal mass 314 may be permanently attached to the inner surface 318 of the support structure 306 by attachment processes such as welding, brazing, or diffusion bonding.

As used herein, the "inner surface 318 of the support structure 306" may refer to an inner surface of the inner frame 216, as illustrated, but may equally refer to the inner surface of the outer frame 214 in the event the inner frame 216 is omitted. Moreover, the "inner surface 318 of the support structure 306" may also refer to horizontal as well as vertical inner surfaces of either the outer or inner frames 214, 216, without departing from the scope of the disclosure. For instance, while the thermal mass 314 is depicted in FIG. 3 as being mechanically fastened to a horizontal inner surface 318 of the support structure 306 with the mechanical fasteners 320, the thermal mass 314 may equally be mechanically fastened to a vertical or sidewall inner surface 318, or a combination of both.

The thermal mass 314 in FIG. 3 may be characterized as a "resistive thermal mass" in that the thermal mass 314 resists heat flow from the top 316 of the mold 200 by incorporating increased insulative capacity or properties at the top end 302*a*. In some embodiments, this may be accomplished by using additional insulating material 322 in the thermal mass 314 to retard the heat flux from the top 316 of the mold 200 through the top end 302*a* of the insulation enclosure 300. The additional insulating material 322 may be the same type of insulation as the insulating material 308. In some embodiments, for instance, the insulating material 322 may comprise a monolithic block of ceramic (e.g., alumina), steel (e.g., 316L stainless steel) or another type of metal. In other embodiments, the insulating material 322 may comprise multiple layers of an insulating blanket, such as a ceramic fiber blanket (e.g., INSWOOL® or the like). Alternately, the insulating material 322 may consist of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, metal fabrics, metal foams, metal wools, metal castings, any composite thereof, and any combination thereof. Furthermore, the thermal mass 314 may exhibit increased insulating properties by containing a fluid in an enclosure, such as a cavity or one or more tubes. Also, the thermal mass 314 may have a composite or hybrid structure, such as ceramic beads in a metallic frame or metallic foam in a ceramic enclosure that may be completely or partially enclosed.

Furthermore, one or more thermal properties of the insulation enclosure 300 may be modified or altered at or near the top end 302*a* to further resist heat flow from the top 316 of the mold 200 in the axial direction A and subsequently through the top end 302*a* of the insulation enclosure 300. For example, an insulative coating, such as a thermal barrier coating, may be applied to one or both of the outer and inner walls at the top end 302*a* or at least one surface of the thermal mass 314. Such an insulative coating may prove advantageous in providing a thermal barrier that may help redirect thermal energy back toward the thermal mass 314 and/or toward the mold 200. In other embodiments, or in addition thereto, the materials used for the support structure 306 and the insulation material 308 at or near the top end 302*a* may exhibit lower thermal conductivities as opposed to the materials used for the support structure 306 and the insulation material 308 at or near the bottom end 302*b*. At least one example of a material that exhibits low thermal conductivity is ceramic, such as a ceramic coating. However, those skilled in the art will readily recognize other materials that exhibit low thermal conductivities that may be equally effective, without departing from the scope of the disclosure. Using such lower thermally conductive materials may prove advantageous in increasing the insulating properties of the insulating can 300 at the top end 302*a*.

Figure 4:
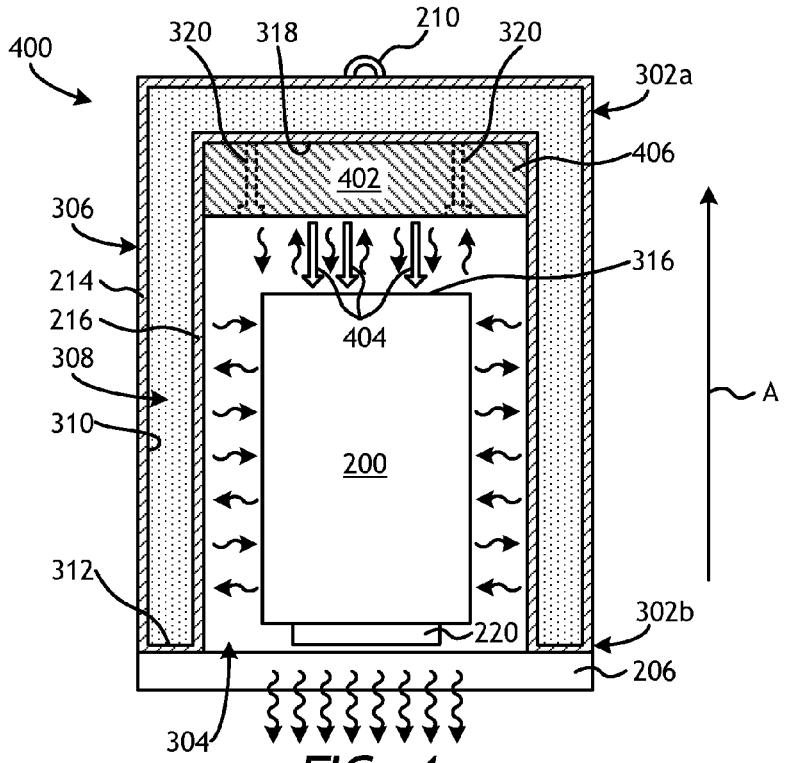
FIG. 4 illustrates a cross-sectional side view of another exemplary insulation enclosure, according to one or more embodiments.

FIG. 4 illustrates a cross-sectional side view of another exemplary insulation enclosure 400, according to one or more embodiments. The insulation enclosure 400 may be similar in some respects to the insulation enclosure 300 of FIG. 3 and therefore may be best understood with reference thereto, where like numerals represent like elements not described again. Similar to the insulation enclosure 300 of FIG. 3, the insulation enclosure 400 may include the support structure 306, including the outer and inner frames 214, 216, and the insulation material 308 supported on the support structure 306, as generally described above. In other embodiments, however, as mentioned above, at least one of the outer and inner frames 214, 216 may be omitted from the insulation enclosure 400.

Moreover, the insulation enclosure 400 may also include a thermal mass 402 arranged at or near the top end 302*a* of the insulation enclosure 400 (i.e., the support structure 306) and used to resist heat flow from the top 316 of the mold 200 in the axial direction A. As with the thermal mass 314 of FIG. 3, the thermal mass 402 may be coupled to or arranged on the insulation enclosure 400 at various locations at or near the top end 302*a* of the support structure 306. For instance, the thermal mass 402 may be positioned within the interior of the insulation enclosure 400 (i.e., the support structure 306) and otherwise secured to the inner surface 318 of the support structure 306, but may also be positioned between the outer and inner frames 216, 214 at the top end 302*a* of the support structure 306, or on the exterior of the insulation enclosure 400, such as on an exterior or interior surface of the outer frame 214 (or an exterior surface of the inner frame 216 in the event the outer frame 214 is omitted). In the illustrated embodiment, the thermal mass 402 is depicted as being secured to the inner surface 318 of the support structure 306 using mechanical fasteners 320, but could also (or in addition thereto) be permanently attached thereto using one or more attachment processes, such as welding, brazing, or diffusion bonding.

Unlike the thermal mass 314 of FIG. 3, however, the thermal mass 402 may be characterized as a "heating thermal mass" configured to impart thermal energy or heat 404 to the mold 200. More particularly, instead of retarding the heat flux from the mold 200, as is the case with the thermal mass 314, the thermal mass 402 may either passively or actively provide heat 404 to the top 316 of the mold 200 such that its thermal profile is altered and reduces heat loss through the top 316 of the mold 200.

One example of a passive-type heating thermal mass 402 is one that is preheated prior to lowering the insulation enclosure 400 around the mold 200. Preheating the thermal mass 402 may prove advantageous in slowing radiative heat flux from the top 316 of the mold 200. More specifically, once removed from the furnace 202 (FIG. 2A), the radiant heat flux from the mold 200 is proportional to the difference between its temperature raised to the fourth power and the temperature of its immediate surroundings raised to the fourth power (temperature measured in an absolute scale, such as Kelvin). The mold 200 may exit the furnace 202 at a temperature in the 1800° F. to 2500° F. range (1255K to 1644K) and immediately radiate thermal energy at a high rate to the room-temperature surroundings (approximately 293K). Once the insulation enclosure 400 is lowered over the mold 200, thermal energy continues to radiate from the mold 200 at a high rate until the temperature of the insulation enclosure 400 is elevated to at or near the temperature of the mold 200. Accordingly, preheating the thermal mass 402 may slow the radiative heat flux from the mold 200.

In such embodiments, the thermal mass 402 may be made of a material that can act as a thermal reservoir 406. Suitable materials for the thermal reservoir 406 include, but are not limited to, a monolithic block of ceramic (e.g., alumina), steel (e.g., 316L stainless steel or another type of metal), or a mass of high heat-capacity material, such as fireclay, fire bricks, stones, ceramic blocks, graphite blocks, and any combination thereof. Alternately, the thermal reservoir 406 may consist of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, metal fabrics, metal foams, metal wools, metal castings, any composite thereof, and any combination thereof. The thermal mass 402 may be preheated, such as within the furnace 202 of FIG. 2A or another type of furnace. In some embodiments, one or more thermal elements (not shown) may be used to preheat the thermal mass 402. For instance, the thermal element(s) may be situated adjacent the thermal mass 402 or otherwise embedded within the thermal mass 402 and activated to increase the temperature of the thermal mass 402. Alternately, the thermal element(s) may be temporarily placed near the thermal mass 402 to preheat the mass before the insulation enclosure 400 is lowered over the mold 200. The resulting preheated thermal mass 402 may provide a reservoir for surplus heat 404 to be emitted toward the top 316 of the mold 200 once the insulation enclosure 400 is lowered over the mold 200 for cooling.

Furthermore, one or more thermal properties of the insulation enclosure 400 may be modified at or near the top end 302*a* to further resist heat flow from the top 316 of the mold 200 in the axial direction A. For example, an insulative coating, such as a thermal barrier coating, may be applied to one or both of the outer and inner walls at the top end 302*a* or at least one surface of the thermal mass 402. In other embodiments, or in addition thereto, the materials used for the support structure 306 and the insulation material 308 at or near the top end 302*a* may exhibit lower thermal conductivities as opposed to the materials used for the support structure 306 and the insulation material 308 at or near the bottom end 302*b*.

Figure 5:
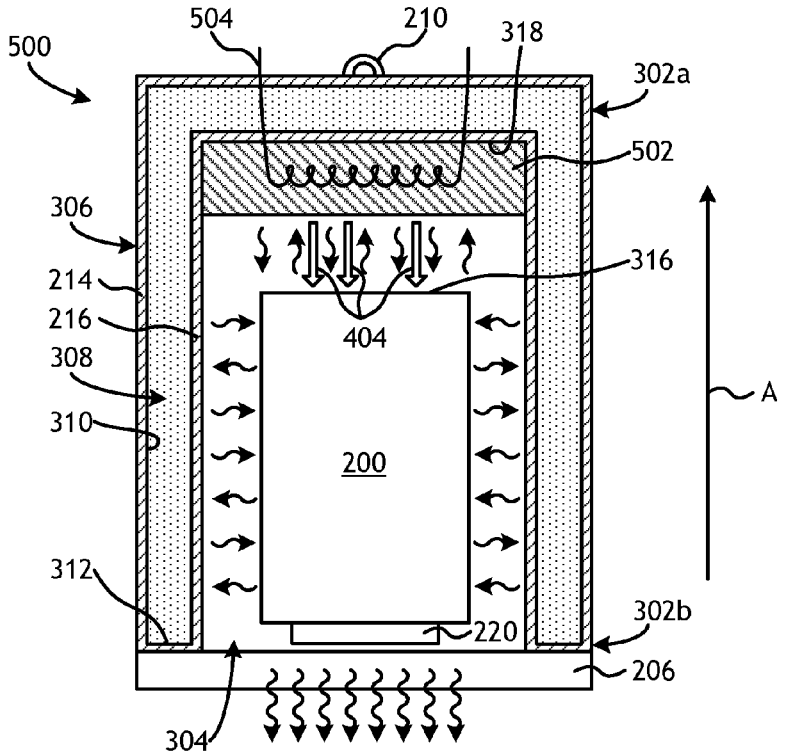
FIG. 5 illustrates a cross-sectional side view of another exemplary insulation enclosure, according to one or more embodiments.

FIG. 5 illustrates a cross-sectional side view of another exemplary insulation enclosure 500, according to one or more embodiments. The insulation enclosure 500 may be similar in some respects to the insulation enclosure 400 of FIG. 4 and therefore may be best understood with reference thereto, where like numerals represent like elements not described again. Similar to the insulation enclosure 400 of FIG. 4, the insulation enclosure 500 may include the support structure 306, including the outer and inner frames 214, 216, and the insulation material 308 supported on the support structure 306, as generally described above.

Moreover, the insulation enclosure 500 may also include a thermal mass 502 arranged at or near the top end 302*a* of the insulation enclosure 500 (i.e., the support structure 306) for resisting heat flow from the top 316 of the mold 200 in the axial direction A. As with the thermal mass 402 of FIG. 4, the thermal mass 502 may be coupled to or arranged on the insulation enclosure 500 at various locations at or near the top end 302*a* of the support structure 306. For instance, the thermal mass 502 may be positioned within the interior of the insulation enclosure 500 (i.e., the support structure 306) and otherwise secured to the inner surface 318 of the support structure 306. The thermal mass 502 may likewise be positioned between the outer and inner frames 216, 214 at the top end 302*a* of the support structure 306 or on the exterior of the insulation enclosure 500, such as on an exterior surface of the outer frame 214.

Similar to the thermal mass 402 of FIG. 4, the thermal mass 502 may be characterized as a "heating thermal mass" that imparts thermal energy or heat 404 to the top 316 of the mold 200. Unlike the thermal mass 402, however, the thermal mass 502 may be an active-type heating thermal mass 502 capable of actively providing a source of the heat 404 to the top 316 of the mold 200. More particularly, the thermal mass 500 may include or otherwise comprise one or more thermal elements 504 (one shown) in thermal communication with the top 316 of the mold 200. In the illustrated embodiment, the thermal element 504 is depicted as an induction coil or heating element that extends into the interior of the insulation enclosure 500, but may equally be any device or mechanism capable of imparting thermal energy (e.g., heat 404) to the mold 200 and, more particularly, through the top 316 of the mold 200. Suitable thermal elements 504 include, but are not limited to, a heating element, a heat exchanger, a radiant heater, an electric heater, an infrared heater, an induction heater (coil), a heating band, heated coils, heated fluids (flowing or static), an exothermic chemical reaction, or any combination thereof. Suitable configurations for a heating element may include, but not be limited to, coils, plates, strips, finned elements, and the like, or any combination thereof.

The thermal element 504 may be in thermal communication with the top 316 of the mold 200 via a variety of configurations. In the illustrated embodiment, for instance, the thermal element 504 is depicted as being embedded within the thermal mass 502, which could be made of a material selected from the group consisting of a block of ceramic (e.g., alumina), steel (e.g., 316L stainless steel or another type of metal), a mass of high heat-capacity material, such as fireclay, fire bricks, stones, ceramic blocks, graphite blocks, and any combination thereof. Alternately, the thermal reservoir 406 may consist of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, metal fabrics, metal foams, metal wools, metal castings, any composite thereof, and any combination thereof. In other embodiments, however, the material for the thermal mass 502 may be omitted and the thermal element 504 may alternatively extend alone into the interior of the insulation enclosure 300. In yet other embodiments, the thermal element 504 may be arranged between the outer and inner frames 216, 214 at the top end 302*a* of the support structure 306 or on the exterior of the insulation enclosure 500, such as on an exterior surface of the outer frame 214 (or an exterior surface of the inner frame 216 in the event the outer frame 214 is omitted), without departing from the scope of the disclosure. The thermal element 504 may be useful in helping to facilitate the directional solidification of the molten contents of the mold 200 as it provides thermal energy (i.e., heat 404) to the top 316 of the mold 200, while the thermal heat sink 206 draws thermal energy out the bottom 220 of the mold 200.

In one or more embodiments, the thermal element 504 may be selectively controlled to optimize directional solidification of the molten contents of the mold 200. For example, in at least one embodiment, the thermal element 504 may be activated before the insulation enclosure 500 is lowered over the mold 200 to preheat the thermal mass 502, and thereby provide the benefits described above with reference to the preheated thermal mass 402 of FIG. 4. In other embodiments, the thermal element 504 may be activated once the insulation enclosure 500 is placed around the mold 200. The thermal element 504 may be activated to provide heat 504 to the mold 300 for a predetermined amount of time, after which the thermal element 504 may be disabled or deactivated to allow the top 316 of the mold 200 to cool.

In some embodiments, one or more additional thermal elements (not shown) may be placed along the sides of the insulation enclosure 500 to help facilitate directional cooling of the mold 200. For example, such thermal elements could be placed along the top third of the sidewalls of the insulation enclosure 500 and otherwise adjacent the thermal mass 502 and the top 316 of the mold 200.

Figure 6:
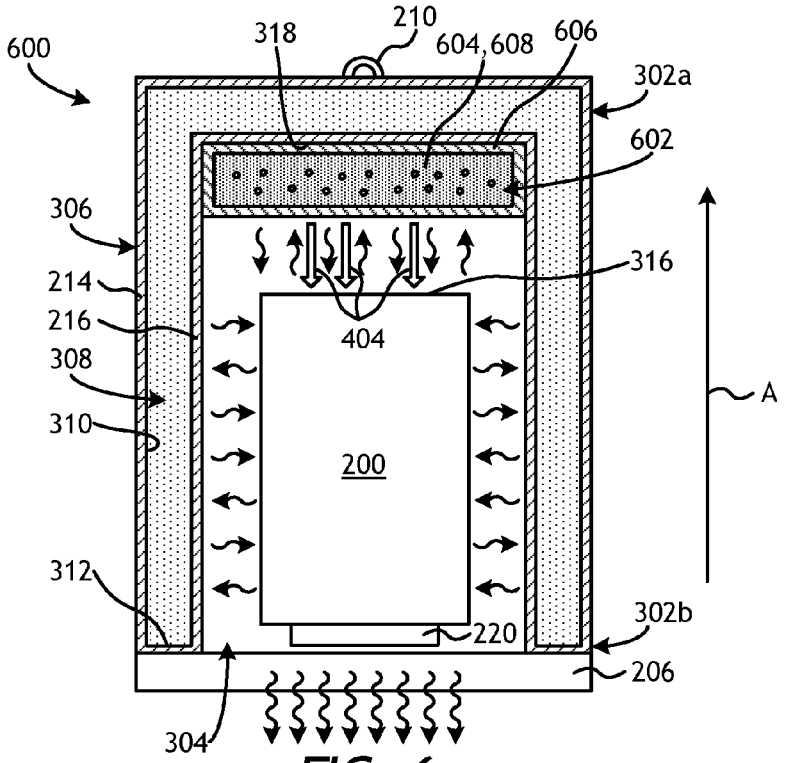
FIG. 6 illustrates a cross-sectional side view of another exemplary insulation enclosure, according to one or more embodiments.

FIG. 6 illustrates a cross-sectional side view of another exemplary insulation enclosure 600, according to one or more embodiments. The insulation enclosure 600 may be similar in some respects to the insulation enclosure 400 of FIG. 4 and therefore may be best understood with reference thereto, where like numerals represent like elements not described again. Similar to the insulation enclosure 400 of FIG. 4, the insulation enclosure 600 may include the support structure 306, including the outer and inner frames 214, 216, and the insulation material 308 supported on the support structure 306, as generally described above.

Moreover, the insulation enclosure 600 may also include a thermal mass 602 arranged at or near the top end 302*a* of the insulation enclosure 600 (i.e., the support structure 306) for resisting heat flow from the top 316 of the mold 200 in the axial direction A. The thermal mass 602 may be coupled to or arranged on the insulation enclosure 600 at various locations at or near the top end 302*a* of the support structure 306. For instance, as illustrated, the thermal mass 602 may be positioned within the interior of the insulation enclosure 600 (i.e., the support structure 306) and otherwise secured to the inner surface 318 of the support structure 306. In other embodiments, the thermal mass 602 could be positioned between the outer and inner frames 216, 214 at the top end 302*a* of the support structure 306 or on the exterior of the insulation enclosure 600, such as on an exterior surface of the outer frame 214.

Similar to the thermal mass 402 of FIG. 4, the thermal mass 602 may be a passive-type thermal mass 602 configured to impart thermal energy or heat 404 to the top 316 of the mold 200. More particularly, the thermal mass 602 may include a molten material 604 positioned within a vessel 606 situated above the top 316 of the mold 200. In some embodiments, the molten material 604 may be a molten metal that is progressing through a phase change from a liquid state to a solid state. Other suitable molten materials 604 include, but are not limited to, a molten metal that remains molten throughout the cooling process of the mold 200 or a molten salt. As the molten material 604 cools and, therefore, proceeds through a phase change process (if applicable), latent heat involved with the phase change may be emitted from the molten material 604 in the form of heat 404 until the molten mass solidifies. As will be appreciated, the time required for the molten material 604 to solidify may prove advantageous in providing additional time to remove thermal energy out of the bottom 220 of the mold 200 via the thermal heat sink 206, and thereby help directionally solidify the molten contents within the mold 200.

In other embodiments, the vessel 606 may be filled with other types of materials and/or substances that serve to slow the cooling process of the mold 200 in the axial direction A. For example, in at least one embodiment, the vessel 606 may enclose a gas 608 and the gas 608 may be configured to act as an insulator for the insulation enclosure 600. Suitable gases that may be sealed within the vessel 606 include, but are not limited to, air, argon, neon, helium, krypton, xenon, oxygen, carbon dioxide, methane, nitric oxide, nitrogen, nitrous oxide, trichlorofluoromethane (R-11), dichlorodifluoromethane (R-12), dichlorofluoromethane (R-21), difluoromonochloromethane (R-22), sulpher hexafluoride, or any combination thereof. The gas 608 may be used in the vessel 606 as an insulator. Accordingly, the thermal mass 602 may alternatively be characterized as a resistive thermal mass, similar to the thermal mass 314 of FIG. 3.

Moreover, in some embodiments, the vessel 606 may include at least one connection to an exterior reservoir or source configured to heat the gas 608 and thereby allow the thermal mass 602 to act as a heating thermal mass. In this manner, the heated gas 608 may be used to fill the vessel 606 once, or the heated gas 608 may continuously cycle gas through the vessel 606 to provide a suitable thermal reservoir. In other embodiments, the gas 608 may be omitted from the vessel 606 and a vacuum may alternatively be formed within the vessel 606.

In yet other embodiments, the thermal mass 603 may exhibit a composite or hybrid structure, where a solid material is ceramic beads positioned within the vessel 606. In one embodiment, for instance, the vessel 606 may be a metallic frame and ceramic beads may be positioned therein. In another embodiment, the vessel 606 may be a ceramic enclosure and metallic foam may be positioned therein. In either case, the vessel 606 may be completely or partially enclosed.

In some embodiments, the thermal mass 602 may be preheated, such as within the furnace 202 of FIG. 2A or another type of furnace. In some embodiments, one or more thermal elements (not shown) may be used to preheat the thermal mass 602. For instance, the thermal element(s) may be situated adjacent the thermal mass 602 or otherwise embedded within the thermal mass 602 and activated to increase the temperature of the thermal mass 602. Alternately, the thermal element(s) may be temporarily placed near the thermal mass 602 to preheat the mass before the insulation enclosure 600 is lowered over the mold 200. The resulting preheated thermal mass 602 may provide a reservoir for surplus heat 404 to be emitted toward the top 316 of the mold 200 once the insulation enclosure 600 is lowered over the mold 200 for cooling.

While the insulation enclosures 300, 400, 500, and 600 described herein are described as including particular configurations, designs, and operations of the corresponding thermal masses 314, 402, 502, and 602, those skilled in the art will readily appreciate that variations in the designs of the insulation enclosures 300, 400, 500, and 600 are possible, without departing from the scope of the disclosure. For example, it will be appreciated that the configurations, designs, and operations of the thermal masses 314, 402, 502, and 602 disclosed herein may be combined in any combination, in keeping within the scope of this disclosure.

Embodiments disclosed herein include:

A. An insulation enclosure that includes a support structure having a top end, a bottom end, and an opening defined at the bottom end for receiving a mold within an interior of the support structure, and a thermal mass arranged at the top end of the support structure to thermally communicate with a top of the mold and resist heat flow from the top of the mold in an axial direction.

B. A method that includes removing a mold from a furnace, the mold having a top and a bottom, placing the mold on a thermal heat sink with the bottom adjacent the thermal heat sink, lowering an insulation enclosure around the mold, the insulation enclosure including a support structure having a top end, a bottom end, and an opening defined at the bottom end for receiving the mold within an interior of the support structure, the insulation enclosure further including a thermal mass arranged at the top end to thermally communicate with the top of the mold, and resisting heat flow from the top of the mold in an axial direction with the thermal mass.

Each of embodiments A and B may have one or more of the following additional elements in any combination: Element 1: further comprising insulation material supported by the support structure, the insulation material being selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, metal forgings, any composite thereof, and any combination thereof. Element 2: wherein the support structure comprises an outer frame and an inner frame and the insulation material is positioned within a cavity defined between the outer and inner frames. Element 3: wherein the support structure includes at least one of an outer frame and an inner frame. Element 4: wherein the insulation enclosure further comprises an insulative coating positioned on at least one of the inner frame and the outer frame. Element 5: wherein the thermal mass is positioned between the outer and inner frames. Element 6: wherein the thermal mass is positioned within the interior of the support structure. Element 7: wherein the thermal mass is arranged on an exterior of the support structure. Element 8: wherein the thermal mass comprises an insulating material selected from the group consisting of ceramic, steel, multiple layers of an insulating blanket, ceramic fiber, ceramic fabric, ceramic wool, ceramic beads, ceramic blocks, moldable ceramic, woven ceramic, cast ceramic, fire brick, carbon fiber, graphite blocks, shaped graphite blocks, metal fabric, metal foam, metal wool, a metal casting, any composite thereof, and any combination thereof. Element 9: wherein the thermal mass is preheated and imparts thermal energy to the top of the mold, the thermal mass comprising a material selected from the group consisting of a ceramic block, a steel block, fireclay, firebrick, stone, a graphite block, ceramic fiber, ceramic fabric, ceramic wool, ceramic beads, moldable ceramic, woven ceramic, cast ceramic, carbon fiber, graphite blocks, shaped graphite blocks, metal fabric, metal foam, metal wool, a metal casting, any composite thereof, and any combination thereof. Element 10: wherein the thermal mass comprises one or more thermal elements in thermal communication with the top of the mold, the one or more thermal elements being selected from the group consisting of a heating element, a heat exchanger, a radiant heater, an electric heater, an infrared heater, an induction heater (coil), a heating band, heated coils, heated fluids (flowing or static), an exothermic chemical reaction, and any combination thereof. Element 11: wherein the one or more thermal elements is embedded within the thermal mass and the thermal mass comprises a material selected from the group consisting of a ceramic block, a steel block, fireclay, firebrick, stone, a graphite block, ceramic fiber, ceramic fabric, ceramic wool, ceramic beads, moldable ceramic, woven ceramic, cast ceramic, carbon fiber, graphite blocks, shaped graphite blocks, metal fabric, metal foam, metal wool, a metal casting, any composite thereof, and any combination thereof. Element 12: wherein the thermal mass comprises a substance positioned within a vessel situated above the top of the mold, the substance being selected from the group consisting of a molten metal, a molten salt, a gas, ceramic beads, a metallic foam, and any combination thereof. Element 13: wherein the gas is selected from the group consisting of air, argon, neon, helium, krypton, xenon, oxygen, carbon dioxide, methane, nitric oxide, nitrogen, nitrous oxide, sulpher hexafluoride, trichlorofluoromethane, dichlorodifluoromethane, dichlorofluoromethane, difluoromonochloromethane, and any combination thereof.

Element 14: further comprising insulating the mold with insulation material supported by the support structure, the insulation material being selected from the group consisting of ceramics, ceramic fibers, ceramic fabrics, ceramic wools, ceramic beads, ceramic blocks, moldable ceramics, woven ceramics, cast ceramics, fire bricks, carbon fibers, graphite blocks, shaped graphite blocks, polymer beads, polymer fibers, polymer fabrics, nanocomposites, fluids in a jacket, metal fabrics, metal foams, metal wools, metal castings, metal forgings, any composite thereof, and any combination thereof. Element 15: wherein the thermal mass comprises an insulating material and resisting the heat flow from the top of the mold in the axial direction comprises resisting the heat flow with the insulating material. Element 16: wherein resisting the heat flow from the top of the mold in the axial direction comprises preheating the thermal mass, and imparting thermal energy to the top of the mold with the thermal mass. Element 17: wherein the thermal mass comprises one or more thermal elements in thermal communication with the top of the mold and resisting the heat flow from the top of the mold in the axial direction comprises activating the one or more thermal elements, and imparting thermal energy to the top of the mold with the one or more thermal elements. Element 18: further comprising activating the one or more thermal elements for a predetermined amount of time while in thermal communication with the top of the mold. Element 19: wherein the thermal mass comprises a molten material positioned within a vessel situated above the top of the mold and resisting the heat flow from the top of the mold in the axial direction comprises imparting thermal energy in the form of latent heat to the top of the mold while the molten material transitions from a liquid state to a solid state. Element 20: wherein the thermal mass comprises a gas positioned within a vessel situated above the top of the mold and resisting the heat flow from the top of the mold in the axial direction comprises resisting the heat flow with the gas. Element 21: further comprising drawing thermal energy from the bottom of the mold with the thermal heat sink.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An insulation enclosure, comprising:

a support structure having a top end, a bottom end, and an opening located at the bottom end for receiving a mold within an interior of the support structure;

a first insulation material supported by the support structure;

a thermal mass arranged below the top end of the support structure to thermally communicate with a top of the mold, the thermal mass incorporating a second insulation material that resists heat flow from the top of the mold in an axial direction, wherein the support structure includes an inner frame and an outer frame; and an insulative coating positioned on at least one of the inner frame and the outer frame.

2. The insulation enclosure of claim 1, wherein the first insulation material being selected from the group consisting of ceramic, ceramic fiber, ceramic fabric, ceramic wool, ceramic beads, ceramic blocks, a moldable ceramic, a woven ceramic, cast ceramic, fire brick, carbon fibers, graphite blocks, shaped graphite blocks, polymer beads, polymer fiber, polymer fabric, a nanocomposite, fluid in a jacket, metal fabric, metal foam, metal wool, a metal casting, a metal forging, any composite thereof, and any combination thereof.

3. The insulation enclosure of claim 2, wherein the support structure comprises an outer frame and an inner frame, and the first insulation material is positioned within a cavity defined between the outer frame and the inner frame.

4. An insulation enclosure, comprising:

a support structure having a top end, a bottom end, and an opening located at the bottom end for receiving a mold within an interior of the support structure;

a first insulation material supported by the support structure; and a thermal mass arranged at the top end of the support structure to thermally communicate with a top of the mold, the thermal mass incorporating a second insulation material that resists heat flow from the top of the mold in an axial direction, wherein the support structure includes an inner frame and an outer frame and wherein the thermal mass is positioned between the outer and inner frames.

5. The insulation enclosure of claim 1, wherein the thermal mass is positioned within the interior of the support structure.

6. The insulation enclosure of claim 1, wherein the thermal mass is arranged on an exterior of the support structure.

7. The insulation enclosure of claim 1, wherein the second insulating material selected from the group consisting of ceramic, steel, multiple layers of an insulating blanket, ceramic fiber, ceramic fabric, ceramic wool, ceramic beads, a ceramic block, moldable ceramic, woven ceramic, cast ceramic, fire brick, carbon fiber, a graphite block, a shaped graphite block, metal fabric, metal foam, metal wool, a metal casting, any composite thereof, and any combination thereof.

8. The insulation enclosure of claim 1, wherein the thermal mass is preheated and imparts thermal energy to the top of the mold.

9. An insulation enclosure, comprising:

a support structure having a top end, a bottom end, and an opening located at the bottom end for receiving a mold within an interior of the support structure;

a first insulation material supported by the support structure; and a thermal mass arranged at the top end of the support structure to thermally communicate with a top of the mold, the thermal mass incorporating a second insulation material that resists heat flow from the top of the mold in an axial direction, wherein the thermal mass comprises one or more thermal elements in thermal communication with the top of the mold, the one or more thermal elements being selected from the group consisting of a heating element, a heat exchanger, a radiant heater, an electric heater, an infrared heater, an induction heater, a coil, a heating band, a heated coil, a heated fluid, a flowing heated fluid, a static heated fluid, an exothermic chemical reaction, and any combination thereof.

10. The insulation enclosure of claim 9, wherein the one or more thermal elements is embedded within the thermal mass, and the thermal mass comprises a material selected from the group consisting of a ceramic block, a steel block, fireclay, firebrick, stone, a graphite block, a ceramic fiber, a ceramic fabric, a ceramic wool, a ceramic bead, a moldable ceramic, a woven ceramic, a cast ceramic, a carbon fiber, a graphite block, a shaped graphite block, a metal fabric, a metal foam, a metal wool, a metal casting, any composite thereof, and any combination thereof.

11. The insulation enclosure of claim 1, wherein the thermal mass comprises a substance positioned within a vessel situated above the top of the mold, the substance being selected from the group consisting of: a molten metal, a molten salt, a gas, a ceramic bead, a metallic foam, any composite thereof and any combination thereof.

12. The insulation enclosure of claim 11, wherein the substance is a gas and wherein the gas is selected from the group consisting of air: argon, neon, helium, krypton, xenon, oxygen, carbon dioxide, methane, nitric oxide, nitrogen, nitrous oxide, sulpher hexafluoride, trichlorofluoromethane, dichlorodifluoromethane, dichlorofluoromethane, difluoromonochloromethane, and any combination thereof.

* * * * *